US007481175B2

(12) United States Patent
Dickman

(10) Patent No.: US 7,481,175 B2
(45) Date of Patent: Jan. 27, 2009

(54) FLOATING DOCK

(76) Inventor: Joseph Dickman, P.O. Box 377, Batesville, IN (US) 47006

( * ) Notice: Subject to any disclaimer, the term of this patent is extended or adjusted under 35 U.S.C. 154(b) by 0 days.

(21) Appl. No.: 11/625,118

(22) Filed: Jan. 19, 2007

(65) Prior Publication Data

US 2007/0169678 A1 Jul. 26, 2007

Related U.S. Application Data

(60) Provisional application No. 60/760,699, filed on Jan. 20, 2006.

(51) Int. Cl.
*B63B 35/44* (2006.01)

(52) U.S. Cl. ..... 114/263

(58) Field of Classification Search ..... 114/45, 114/263

See application file for complete search history.

(56) References Cited

U.S. PATENT DOCUMENTS

| | | | | |
|---|---|---|---|---|
| 1,300,954 | A | 4/1919 | Gray | |
| 3,126,855 | A | 3/1964 | Freeburg | |
| 3,734,046 | A | 5/1973 | Schmidt et al. | |
| 4,694,770 | A | 9/1987 | Kitner et al. | |
| 4,727,820 | A | 3/1988 | Klaus | |
| 5,184,913 | A | 2/1993 | Meriwether | |
| 5,249,545 | A | 10/1993 | Gettman | |
| 5,281,055 | A | 1/1994 | Neitzke et al. | |
| 5,354,222 | A | 10/1994 | Elias | |
| 5,388,544 | A | 2/1995 | Kobayashi | |
| 5,529,013 | A | 6/1996 | Eva, III et al. | |
| D378,813 | S | 4/1997 | Jacques | |
| 5,636,587 | A | 6/1997 | Klimowicz | |
| 5,645,007 | A | 7/1997 | Benton | |
| 5,676,088 | A | 10/1997 | Blaisdell et al. | |
| 5,682,833 | A | 11/1997 | Eva, III et al. | |
| 5,715,770 | A | 2/1998 | Heyworth | |
| 5,795,098 | A | 8/1998 | Rueckert | |
| D398,576 | S | 9/1998 | Hillman et al. | |
| D401,547 | S | 11/1998 | Karliner | |
| 5,855,180 | A | 1/1999 | Masters | |
| 5,875,727 | A | 3/1999 | Elson et al. | |
| 5,913,278 | A | 6/1999 | Mitchell | |
| 5,931,113 | A | 8/1999 | Eva, III et al. | |
| 5,941,660 | A | 8/1999 | Rueckert | |
| 5,947,050 | A | 9/1999 | Eva, III et al. | |
| 6,006,687 | A * | 12/1999 | Hillman et al. | 114/46 |
| 6,182,595 | B1 | 2/2001 | Morris | |
| 6,289,837 | B1 | 9/2001 | Stetzel | |
| 6,374,763 | B1 | 4/2002 | Hartman | |

(Continued)

*Primary Examiner*—Jesús D Sotelo
(74) *Attorney, Agent, or Firm*—Wood, Herron & Evans LLP

(57) ABSTRACT

A floating dock for supporting a personal watercraft out of the water when not in use. The floating dock comprises an elongate platform having a recess on its upper surface. The recess is shaped to receive the hull of the personal watercraft and has a forward wall portion for engaging the bow of the hull. A rub-rail post extends upwardly from the upper surface of the platform, forward of the recess, to engage the rub-rail of the personal watercraft in the event that the personal watercraft is moved too far into the recess, thereby preventing the personal watercraft from riding up and over the floating dock. In one embodiment, the platform is a unitary structure formed in a rotational molding process and includes inserts molded therewith to facilitate securing accessories to the platform.

19 Claims, 3 Drawing Sheets

U.S. PATENT DOCUMENTS

| | | | | |
|---|---|---|---|---|
| 6,431,106 | B1 | 8/2002 | Eva, III et al. | |
| 6,477,968 | B2 | 11/2002 | Powell | |
| 6,520,728 | B1 | 2/2003 | Schwitters | |
| 6,526,902 | B1 | 3/2003 | Faber | |
| 6,769,839 | B2 | 8/2004 | Elson | |
| 6,823,809 | B2 | 11/2004 | Hey | |
| 7,069,872 | B2 * | 7/2006 | Ostreng et al. | 114/263 |
| 7,293,522 | B1 * | 11/2007 | Elson | 114/263 |
| 2004/0018054 | A1 | 1/2004 | Rueckert | |
| 2004/0216658 | A1 | 11/2004 | Lin | |
| 2004/0221789 | A1 | 11/2004 | Nelson | |

* cited by examiner

FLOATING DOCK

This application claims priority to U.S. Provisional patent application Ser. No. 60/760,699, filed Jan. 20, 2006, and incorporated by reference herein in its entirety.

TECHNICAL FIELD

Docks for watercraft and, more particularly, floating docks for buoyantly supporting watercraft out of the water when not in use.

BACKGROUND

The use of personal watercraft, such as jet skis, is becoming increasingly popular for various recreational and marine-related activities. Like other watercraft, it is convenient to store frequently used personal watercraft in the water at a marina or pier to permit ready access when needed. Often, however, it is desirable to support the personal watercraft out of the water when not in use. Various lifts or floating docks have been proposed to raise or support personal watercraft above the surface of the water when not in use. Many of these devices comprise complex mechanical systems that require electric power and/or are generally cumbersome to use. Other devices for supporting personal watercraft out of the water permit riding the personal watercraft directly onto the device, or they may include a winch or other mechanism to facilitate drawing the personal watercraft onto the device. One drawback of these prior devices is that users may overshoot the support portion of the device, thereby causing damage to the personal watercraft and/or the pier to which the device is secured.

A need therefore exists for a floating dock for supporting personal watercraft which overcomes these and other drawbacks of the prior art.

SUMMARY

In one embodiment, a floating dock for supporting a personal watercraft above the surface of a body of water includes a unitary, molded platform having an upper surface, a lower surface, a front end, and a rear end. An elongate recess is formed into the upper surface and is contoured in a shape that is complementary to the shape of the hull of a personal watercraft such that the hull may be seated within the recess when the personal watercraft is supported on the platform. The recess includes a forward wall portion near the front end of the platform that is shaped to engage the bow of the watercraft's hull. A rub-rail post at the front end of the platform extends vertically upward from the upper surface to engage the rub-rail of the personal watercraft in the event that the personal watercraft is moved too far onto the platform, thereby preventing the watercraft from riding up and over the dock.

In one embodiment, the platform may be formed as a rotationally molded unit having the features described above. In this embodiment, the platform has a shell structure with an internal cavity. The internal cavity may be filled with air or, alternatively, a buoyant material. To improve the rigidity and stiffness of the molded platform structure the platform may also include internal walls formed in the interior cavity. In one embodiment, the interior walls are formed as "kiss-offs". A "kiss-off" is a term of art that refers to a molded structure formed by bringing spaced, opposing wall surfaces together in a desired area such that the material of the opposed walls is joined or fused in that area to define a common interface. The platform may include various other structural features, such as pockets, ribs, or specially-shaped wall structures to improve the strength and rigidity of the platform.

In another embodiment, the dock may include rollers disposed on the upper surface of the platform. This embodiment may facilitate loading a personal watercraft onto the dock, or unloading the personal watercraft from the dock. The platform may also include a winch or other device that facilitates drawing a personal watercraft onto the platform. The dock may further include inserts that can be integrally molded with the platform and which have external or internal threads. The rollers, winch, and other accessories may be secured to the platform using fasteners that are threadably engaged with the threaded inserts.

These and other features, objects and advantages in accordance with the principles of the invention will become more readily apparent to those skilled in the art in view of the following detailed description, taken in conjunction with the accompanying drawings.

BRIEF DESCRIPTION OF THE FIGURES

The accompanying drawings, which are incorporated in and constitute a part of this specification, illustrate embodiments and, together with the description, serve to explain the principles of the invention.

DETAILED DESCRIPTION

Figure 1:
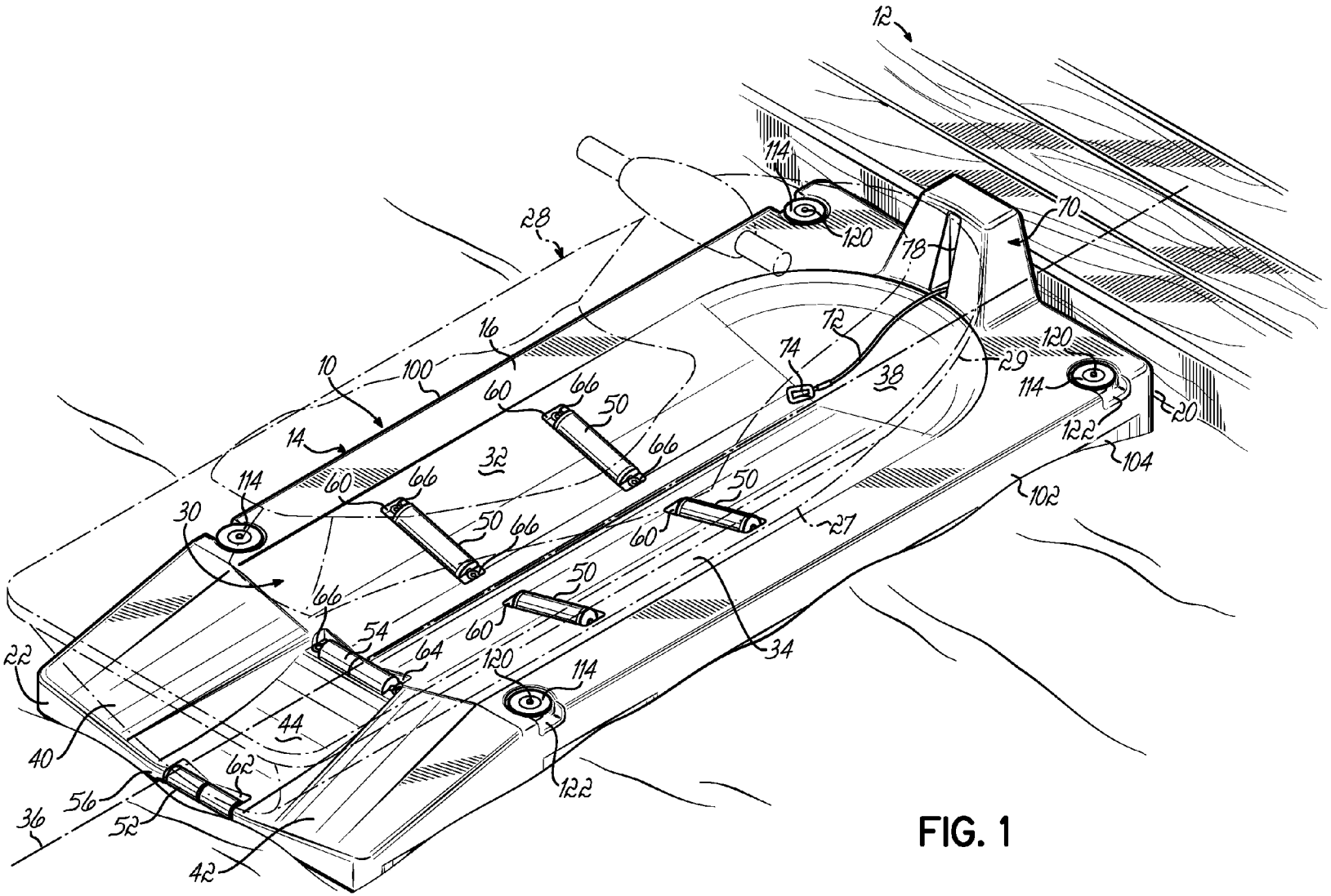
FIG. 1 is a perspective view of an exemplary floating dock for personal watercraft, in accordance with the principles of the present invention.

FIGS. 1-4 depict an exemplary floating dock 10 for supporting personal watercraft out of the water when not in use. The floating dock 10 may be secured to a pier 12 or other structure adjacent a body of water. Due to the buoyant nature of the floating dock 10, it is able rise and fall with the water level and thereby facilitate easy ingress and egress of personal watercraft directly onto or off of the floating dock 10. In the embodiment shown, the floating dock 10 comprises an elongate, unitary platform 14 having an upper surface 16, a lower surface 18, a front end 20, and a rear end 22. In this embodiment, the platform 14 comprises a unitary, molded structure formed from polyethylene, or any other suitable polymeric material, in a rotational molding process. The platform 14 therefore has a hollow interior cavity 24 that may be filled with air or, alternatively, a buoyant material 26, such as an expandable foam.

A recess 30 is formed into the top surface 16 of the platform 14 and extends in a generally longitudinal direction. The recess 30 is contoured to correspond to the shape of a hull 27 of a personal watercraft 28 (illustrated in phantom in FIG. 1) such that a personal watercraft 28 supported on the floating dock 10 will be seated within the recess 30. The recess 30 includes central sidewalls 32, 34 that are inclined in directions downwardly and inwardly toward the centerline 36 of the platform 14. A bow wall 38 of the recess 30, near the front end 20 of the platform 14, is inclined downwardly and inwardly in a direction toward the rear end 22 of the platform 14 and is contoured to correspond to the shape of the bow portion of the hull 27 of a personal watercraft 28. Accordingly, when a personal watercraft 28 is supported on the platform 14, the hull 27 will be seated within the recess 30 with the bow engaged against the bow wall 38 of the recess 30.

To facilitate ingress and egress of a personal watercraft 28, the top surface 16 of the platform 14 near the rear end 22 of the floating dock 10 is also inclined, with oppositely disposed rear sidewalls 40, 42 sloped in directions downwardly and inwardly toward the centerline 36 of the platform 14, and downwardly in a direction toward the rear end 22 of the platform 14. Between the two rear sidewalls 40, 42 is an inclined intermediate wall 44 that is sloped in a direction downwardly toward the rear end 22 of the platform 14. The rear portion of the recess 30 therefore provides a ramp that facilitates mounting a personal watercraft 28 onto the floating dock 10, for example, by driving the personal watercraft 28 onto the floating dock 10, or by drawing the personal watercraft 28 onto the floating dock 10, using a rope or cable, for example.

The floating dock 10 may further include one or more rollers to facilitate loading personal watercraft 28 onto and unloading personal watercraft 28 from the platform 14. In the embodiment shown, pairs of rollers 50 are provided on each of the central sidewalls 32, 34 of the recess 30, spaced apart in a direction from the front end 20 to the rear end 22 of the platform 14. Rollers 50 engage the hull 27 of a personal watercraft 28 and support the personal watercraft 28 on the platform 14. Two additional rollers 52, 54 are provided at the rear of the platform 14, one roller 52 at the rear edge wall 56 and one roller 54 positioned between the sloped intermediate wall 44 and the central sidewalls 32, 34 of the recess 30. Rollers 52, 54 engage the keel of a personal watercraft 28 during loading and unloading, and are tapered to facilitate centering the personal watercraft 28 on the platform 14 during loading.

The rollers 50, 52, 54 are located in generally elongate pockets 60, 62, 64 formed into the upper surface 16 of the platform 14 and may be secured within the pockets 60, 62, 64 using conventional threaded fasteners 66 installed into threaded inserts that are formed with the unitary platform 14, as described in more detail below. It will be appreciated that various other numbers and arrangements of rollers 50, 52, 54 may be utilized to facilitate loading, unloading, and supporting personal watercraft 28 on the platform 14. In one embodiment, the rollers 50, 52, 54 are formed from non-marring polyurethane to prevent marking the hull 27 of a personal watercraft 28 supported thereon. The rollers 50, 52, 54 may further comprise brass shafts and fittings to inhibit corrosion and binding of the rollers.

The floating dock 10 further includes a rub-rail post 70 extending vertically upwardly from the upper surface 16 of the platform 14 and positioned just forward of the bow wall 38 of the recess 30. In the embodiment shown, the rub-rail post 70 is integrally formed with the body of the platform 14 and includes an optional, vertically extending pocket 78 to strengthen the post 70. While an integrally formed rub-rail post 70 is shown and described herein, it will be recognized that the rub-rail post 70 may alternatively be formed separately from the platform 14 and thereafter secured to the front end 20 of the platform 14. The rub-rail post 70 extends above the upper surface 16 of the platform 14 and the bow wall 38 of the recess 30 so that the rub-rail 29 of a personal watercraft 28 will engage the rub-rail post 70 if the personal watercraft 28 is driven or otherwise caused to be positioned on the platform 14 too far into the recess 30 such that the bow of the personal watercraft moves beyond the bow wall 38 of the recess 30. A wall surface of the rub-rail post 70 above bow wall 38 may be concave in shape to facilitate contact between rub-rail post 70 and the rub-rail 29 of the personal watercraft 28. In this manner, the rub-rail post 70 prevents the personal watercraft 28 from riding up and over the platform 14 toward the pier 12.

The floating dock 10 may also include a cable 72 or other structure for securing the personal watercraft 28 within the recess 30 once the personal watercraft 28 has been properly positioned on the platform 14. In the embodiment shown, the floating dock 10 includes a cable 72 attached near the front end 20 of the platform 14 and having a hook or ring 74 which may be secured to the bow hook (not shown) of the personal watercraft 28. The floating dock 10 may further include a winch 76 (FIG. 2) to facilitate controlled loading and unloading of the personal watercraft 28 from the floating dock 10. In the embodiment shown, a support member 80 of the winch 76 is secured at the front end 20 of the platform 14, forward of rub-rail post 70, using conventional fasteners, for example, threadably engaged with threaded inserts integrally molded with the platform 14, as will be described in more detail below.

Figure 4:
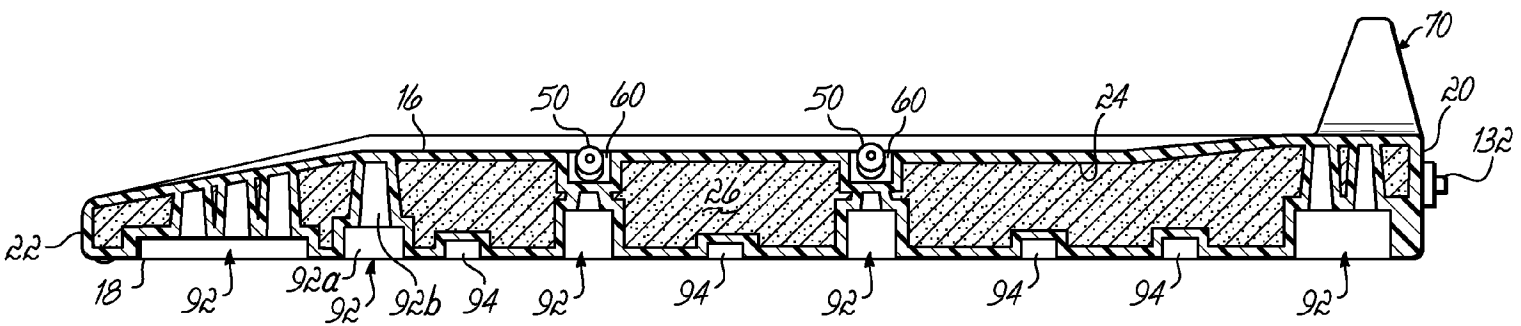
FIG. 4 is a cross-sectional view of the floating dock of FIG. 2, taken along line 4-4.

To provide strength and rigidity to the floating dock 10, the rotationally molded platform 14 may include internal walls within the interior cavity 24. With reference to FIG. 4, the embodiment shown includes a plurality of internal walls formed as "kiss-offs" 92, wherein at least one of the walls defining the upper or lower surfaces 16, 18 of the platform 14 are extended inwardly in directions toward the opposite surface 16, 18. In the embodiment shown, the "kiss-offs" 92 are formed by extending the lower surface 18 of the platform 14 in a direction toward the upper surface 16. The materials forming the upper and lower surfaces 16, 18 meet and become one at these areas. In the embodiment shown, the "kiss-offs" 92 are formed in two stages, a first stage comprises generally rectangular recesses 92*a* formed into the bottom 18 of the platform 14 and extending in a direction toward the upper surface 16. The second stage of the "kiss-offs" 92 comprises cone-shaped columns 92*b* extending from the recesses 92*a* to the material forming the upper surface 16.

Figure 3:
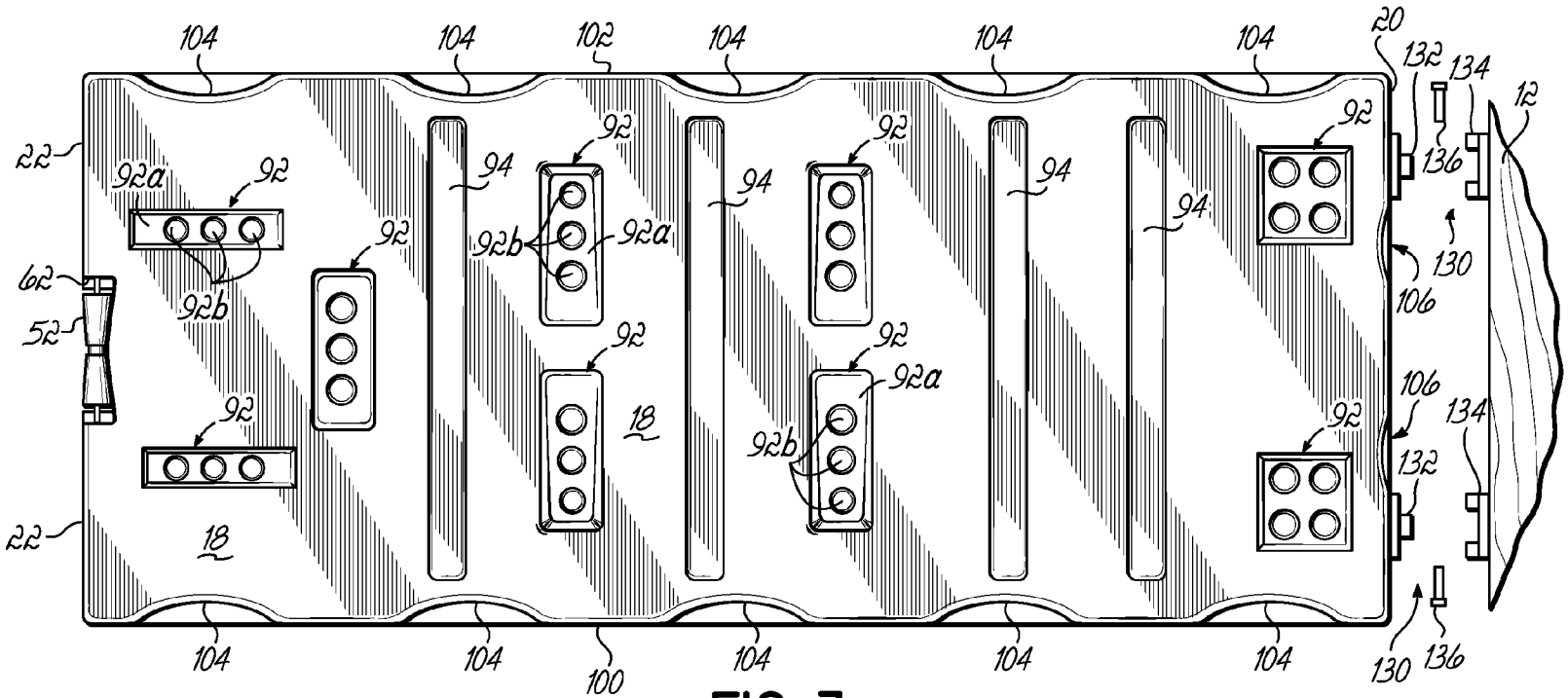
FIG. 3 is a bottom plan view of the floating dock of FIG. 1.

With reference to FIG. 3, the platform 14 may also include one or more elongate pockets 94 formed into the lower surface 18 to increase the rigidity and strength of the platform 14. To further increase the strength of the floating dock 10, the left-hand and right-hand sides 100, 102 of the platform 14 may each include offset portions 104 extending in directions toward the opposite side 100, 102, resulting in a scalloped appearance. The platform 14 may also include offset portions 106 formed into the front end 20 and extending toward the rear end 22. While the embodiment shown includes "kiss offs" 92, pockets 94, and offset portions 104, 106, it will be appreciated that the platform 14 may also include rib sections or various other structure incorporated into the platform 14 to increase the strength and rigidity of the dock 10.

Figures 2, 5:
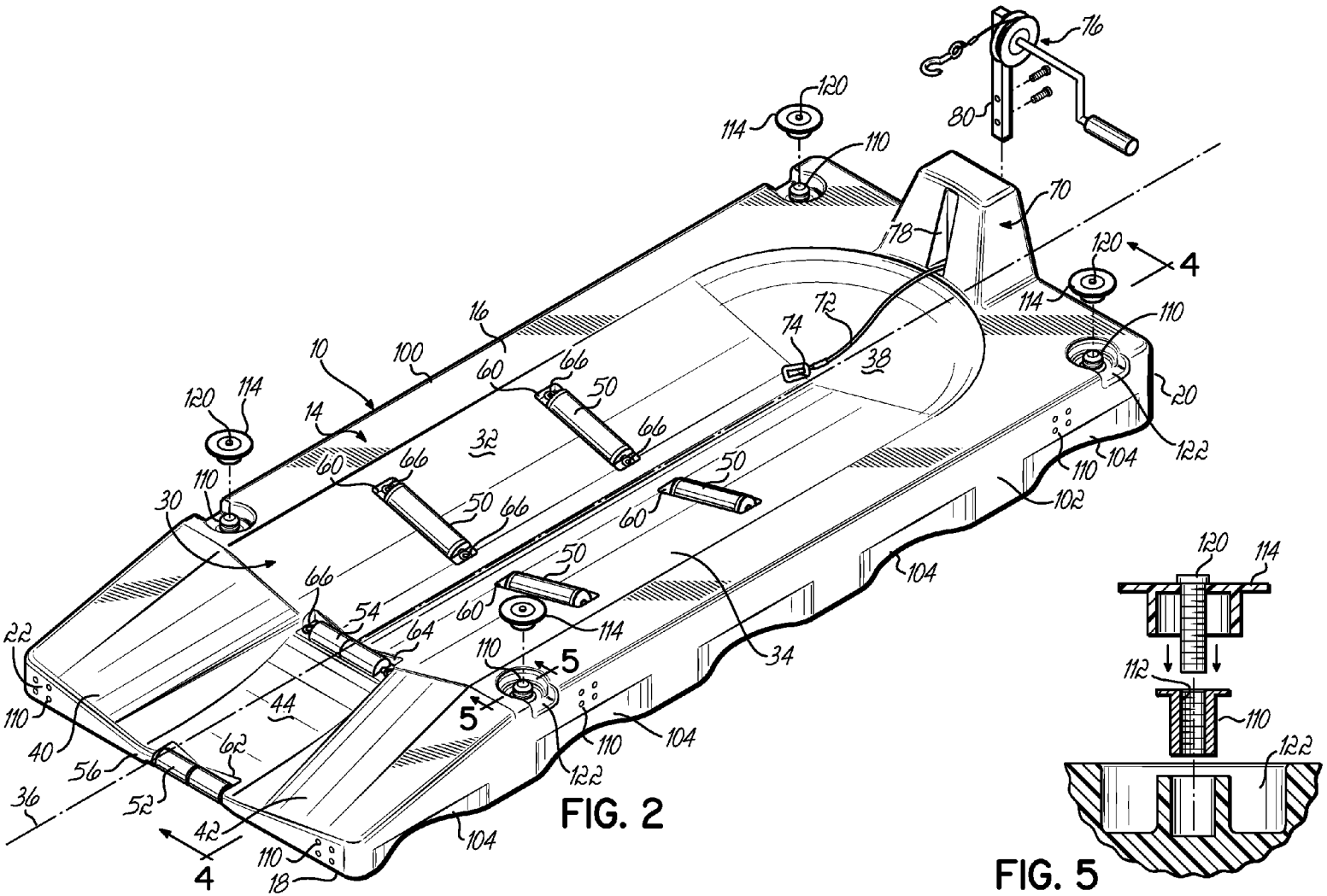
FIG. 2 is an exploded perspective view of the floating dock of FIG. 1.
FIG. 5 is a cross-sectional view of the floating dock of FIG. 2, taken along line 5-5.

As shown in FIG. 5, the platform 14 may further include inserts 110 integrally molded with the platform structure during the rotational molding process. The inserts 110 may have internal or external screw threads 112 and may be positioned at various locations on the platform 14 to facilitate securing rollers 50, 52, 54, winches 76, or other attachments to the floating dock 10. In the embodiment shown, the floating dock 10 further includes one or more cleats 114 secured to the upper surface 16 of the platform 14 to facilitate securing a cover over a personal watercraft 28 supported on the dock 10, or to permit other watercraft to tie-up alongside the dock 10. The cleats 114 may be attached to the platform 14 using conventional fasteners, such as bolts 120, threaded into inserts 110 that are molded into platform 14 at desired locations, such as along the perimeter of the platform 14. In the embodiment shown, pockets 122 are formed into the upper surface 16 where the cleats 114 are attached, so that the cleats 114 do not extend above the upper surface 16. The pockets 122 may be open along one side to facilitate tying a line to the cleat 114 and to permit water to drain from the upper surface 16 of the platform 14.

In another embodiment, the floating dock 10 may further include a bracket assembly 130 located at the front end 20 of the platform 14 for securing the floating dock 10 to a pier 12 or other structure, as depicted in FIGS. 3-4. In the embodiment shown, the bracket assembly 130 includes a first bracket 132 secured to the front end 20 of the platform 14, using fasteners threadably secured to inserts 110, for example. A second bracket 134 is adapted to be coupled to a pier 12 or other structure. The bracket assembly 130 further includes a pin 136 that can be coupled to each of the first and second brackets 132, 134. In one embodiment, the pin 136 permits relative pivotal movement between the first and second brackets 132, 134 to accommodate movement of the dock 10 relative to the pier 12.

In yet another embodiment, threaded inserts 110 may be provided at locations along the sides 100, 102, or along the rear edge wall 56 to provide convenient mounting structure for securing accessories to the platform 14, as depicted in FIG. 2. For example, bracket assemblies 130 as discussed above may be secured to the sides 100, 102 of the platform 14 to facilitate coupling several floating docks 10 to one another in a side-by-side relationship. In another embodiment, tie-plates (not shown) may be secured to respective threaded inserts 110 located at the rear edge walls 56 of adjacent docks 10 to secure the docks 10 together in a side-by-side arrangement. While bracket assemblies 130 and tie-plates have been described herein, it will be appreciated that various other accessories may be secured to the platform 14 using the threaded inserts 110.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the general inventive concept.

What is claimed is:

1. A floating dock for supporting a personal watercraft, comprising:

a molded platform having an upper surface, a lower surface, a front end, and a rear end;

an elongate recess formed into said upper surface of said platform and adapted to receive a hull of a personal watercraft;

said recess including a wall portion proximate said front end of said platform adapted to engage the bow of the watercraft supported on said platform; and a rub-rail post proximate said front end of said platform and extending vertically upwardly from said upper surface;

said rub-rail post including a wall surface facing said rear end of said platform and extending from said upper surface of said platform to a distal end of said rub-rail post, said wall surface adapted to contact a rub rail of a personal watercraft received in said recess;

wherein said wall surface is concave in shape for contacting the rub rail of the personal watercraft.

2. The dock of claim 1, further comprising a plurality of rollers disposed on said upper surface of said platform and within said recess, said plurality of rollers adapted to facilitate positioning the personal watercraft onto and removing the personal watercraft from said platform.

3. The dock of claim 2, further comprising: a plurality of pockets formed into said upper surface of said platform; each of said plurality of rollers at least partially disposed on one of said pockets.

4. The dock of claim 2 wherein said plurality of rollers includes at least one roller on said rear end of said platform.

5. The dock of claim 1, wherein said platform comprises a rotationally molded body.

6. The dock of claim 1, wherein said platform includes an interior cavity.

7. The dock of claim 6, further comprising a buoyant material in said interior cavity.

8. The dock of claim 6, further comprising at least one wall formed within said interior cavity for strengthening said platform

9. The dock of claim 8, wherein said wall is formed by extending at least one of said upper and lower surfaces into said cavity in a direction toward the other of said upper and lower surfaces.

10. The dock of claim 1, further comprising:

at least one insert integrally molded with said platform, said insert adapted for attaching accessories to said platform.

11. The dock of claim 10, further comprising at least one cleat coupled to said insert.

12. The dock of claim 1, wherein said rear end of said platform is sloped to facilitate loading and unloading the personal watercraft from said platform.

13. The dock of claim 1, further comprising a cable for securing the personal watercraft to said platform.

14. The dock of claim 13, wherein said cable is secured to said rub-rail post.

15. The dock of claim 1, further comprising a winch support member mounted proximate said front end of said platform and a winch supported on said winch support member to facilitate loading and unloading the personal watercraft from said platform.

16. The dock of claim 15, wherein said winch support member is supported on said rub-rail post.

17. The dock of claim 1, further comprising a bracket assembly proximate said front end of said platform for securing said platform to a pier structure.

18. The dock of claim 17, wherein said bracket assembly is configured to permit said platform to rise and fall relative to said pier structure as said platform floats in the water.

19. A floating dock for supporting a personal watercraft, comprising:

a molded platform having an upper surface, a lower surface, a front end, and a rear end;

an elongate recess formed into said upper surface of said platform and adapted to receive a hull of a personal watercraft;

said recess including a wall portion proximate said front end of said platform adapted to engage the bow of the watercraft supported on said platform;

a rub-rail post proximate said front end of said platform and extending vertically upwardly from said upper surface;

said rub-rail post including a wall surface facing said rear end of said platform and extending from said upper surface of said platform to a distal end of said rub-rail post, said wall surface adapted to contact a rub rail of a personal watercraft received in said recess; and a winch operatively coupled to a winch support member, said winch support member mounted to said platform such that said rub-rail post is disposed between said wall portion of said recess and said winch support member.

* * * * *